United States Patent [19]

Hanami

[11] Patent Number: 5,057,982

[45] Date of Patent: Oct. 15, 1991

[54] INDICATOR LAMP

[75] Inventor: Chiyoki Hanami, Tokyo, Japan

[73] Assignee: Hirose Electric Co., Ltd., Tokyo, Japan

[21] Appl. No.: 598,439

[22] Filed: Oct. 16, 1990

[30] Foreign Application Priority Data

Oct. 16, 1989 [JP] Japan ..... 1-119694[U]

[51] Int. Cl.[5] ..... H01R 33/00

[52] U.S. Cl. ..... 362/226; 362/800; 362/368

[58] Field of Search ..... 362/800, 226, 368; 439/56, 57, 58; 357/75

[56] References Cited

U.S. PATENT DOCUMENTS

| | | | |
|---|---|---|---|
| 2,945,989 | 7/1960 | Vogel et al. | 439/56 |
| 4,152,622 | 5/1979 | Fitzgerald | 439/56 |
| 4,547,840 | 10/1985 | Tinder | 262/226 |
| 4,580,859 | 8/1986 | Frano et al. | 339/91 R |
| 4,667,270 | 5/1987 | Yagi | 361/380 |
| 4,727,648 | 3/1988 | Savage, Jr. | 29/839 |
| 4,837,927 | 6/1989 | Savage, Jr. | 29/839 |
| 4,897,769 | 1/1990 | Lang | 262/800 |

*Primary Examiner*—James C. Yeung
*Assistant Examiner*—Y. Quach
*Attorney, Agent, or Firm*—Kanesaka & Takeuchi

[57] ABSTRACT

An indicator lamp employing a light emitting diode (50) with a pair of leads, which includes a PCB socket (53) to be mounted on a printed circuit board; a removable socket (1) having an insert portion to be fitted into the PCB socket; a first lead terminal (4) provided in the removable socket and having a resistor contact and a first lead contact for contact with one of the leads; a second lead terminal (5) provided in the removable socket and having a first contact portion and a second lead contact for contact with the other lead; a contact terminal (6) provided within the removable socket and having a second contact portion and a second resistor contact; and a resistor (7) provided within the removable socket so that the resistor is held between the first and second resistor contacts.

1 Claim, 13 Drawing Sheets

INDICATOR LAMP

BACKGROUND OF THE INVENTION

1. Field of the Invention

The present invention relates to indicator lamps for indicators of automatic transmission or the like.

2. Description of the Prior Art

Conventionally, incandescent lamps have been used as automobile indicator lamps. As FIGS. 41–44 show, such an incandescent lamp has a socket 70 to be mounted on a printed circuit board 77. The PCB socket 70 has an abutment flange 71 and a cylindrical mouth 72 which has a pair of opposed slits 73*a* and 73*b*. A pair of latch arms 74 with an engagement shoulder 75 are provided on the outside of the mouth 72. The pair of contact elements 75 and 76 are provided within the PCB socket 70. A pair of contact portions 75*a* and 76*a* extend radially form these contact elements 75 and 76 on the abutment flange 71 beyond the slits 73 and 73*b*, respectively. The PCB 77 has a mounting hole 78 which has a pair of opposed notches 79.

An electric bulb 80 is mounted on the PCB socket 70, and the mount 72 is inserted through the mounting hole 78 so that the abutment flange 71 abuts on the mounting surface of the PCB 77. Then, the PCB socket 70 is turned so that the edge of the mounting hole 78 engages with the engagement shoulders 75 to attach the electric build 80 to the PCB 77. Consequently, the contact portions 75*a* and 76*a* are brought into contact with the contact portions of the mounting surface.

However, the above incandescent lamps consume considerable amounts of power, are vulnerable to vibration or shock, have short service time, and produce considerable amounts of heat.

SUMMARY OF THE INVENTION

Accordingly, it is an object of the invention to provide an indicator lamp which is able to use a light emitting diode, thereby eliminating the above disadvantages.

According to the invention there is provided an indicator lamp employing a light emitting diode with a pair of leads, which includes a PCB socket to be mounted on a printed circuit board; a removable socket having an insert portion to be fitted into the PCB socket; a first lead terminal provided in the removable socket and having a resistor contact and a first lead contact for contact with one of the leads; a second lead terminal provided in the removable socket and having a first contact portion and a second lead contact for contact with the other lead; a contact terminal provided within the removable socket and having a second contact portion and a second resistor contact; and a resistor provided within the removable socket so that the resistor is held between the first and second resistor contacts.

A light emitting diode is mounted on a printed circuit board by mounting the LED on a removable socket, then the removable socket into a PCB socket, and finally the PCB socket on the PCB.

Since an LED is replaced for an incandescent lamp, it is possible to eliminate such disadvantages as high power consumption, vulnerability to vibration and shock, short service time, and high heat generation. However, an electric lamp may also be mounted on the PCB socket.

The above and other objects, features, and advantages of the invention will be more apparent from the following description when taken in connection with the accompanying drawings.

DESCRIPTION OF THE PREFERRED EMBODIMENT

Figure 1:
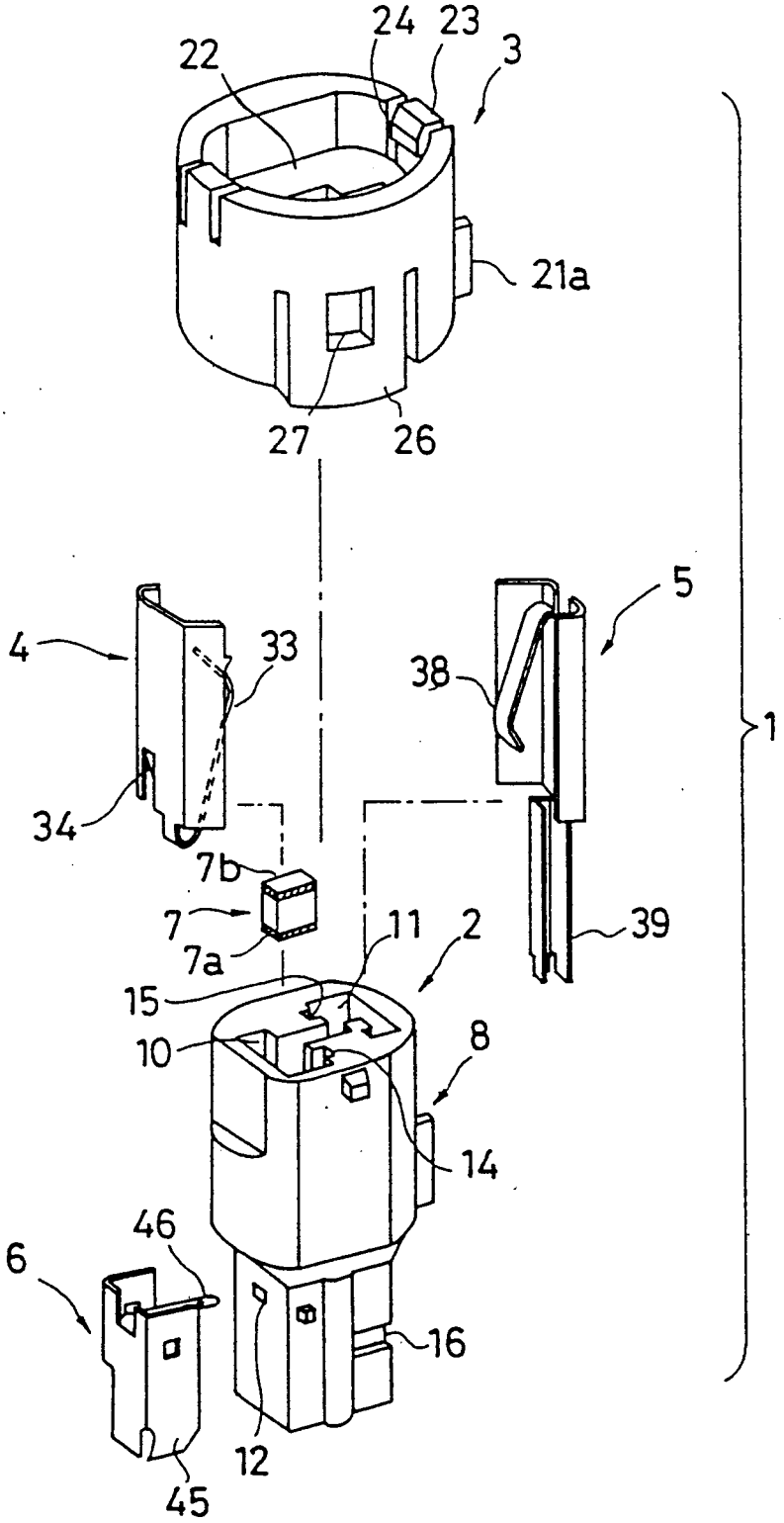
FIG. 1 is an exploded, perspective view of a socket of an indicator according to an embodiment of the invention.
Figure 4:
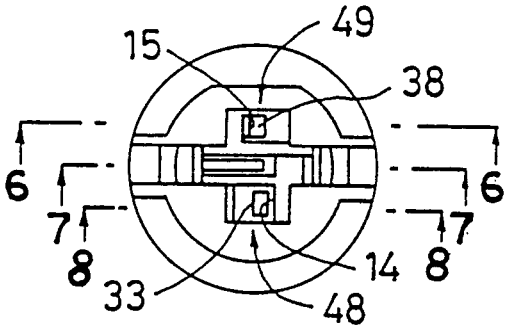
FIG. 4 is a top plan view of the socket.
Figure 2:
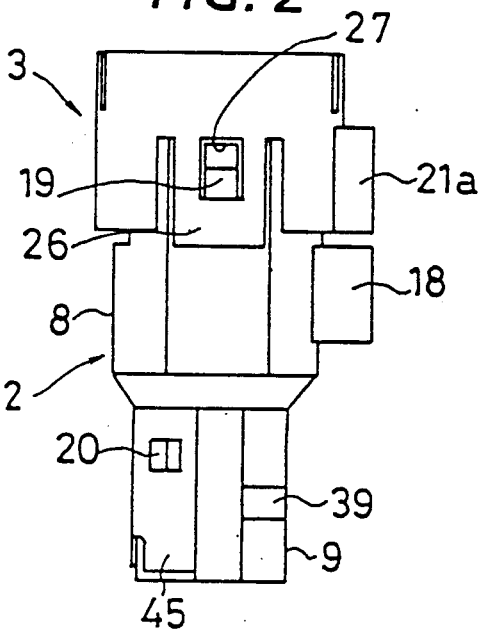
FIG. 2 is a front elevational view of the socket.
Figure 3:
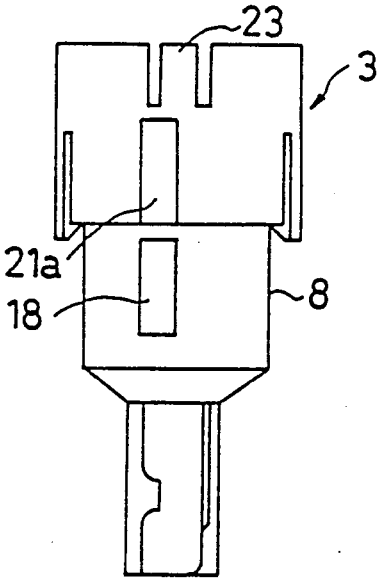
FIG. 3 is a right-hand side view of the socket.
Figure 5:
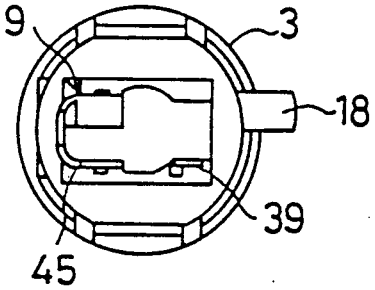
FIG. 5 is a bottom plan view of the socket.
Figure 6:
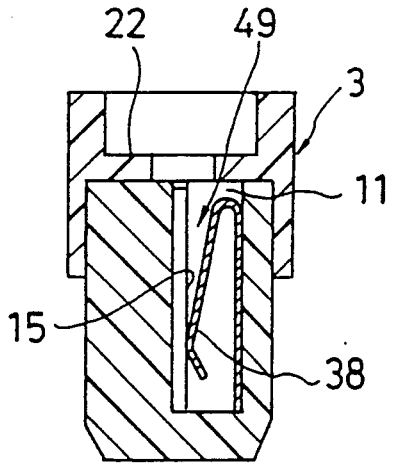
FIG. 6 is a sectional view taken along the line 6—6 of FIG. 4.
Figure 7:
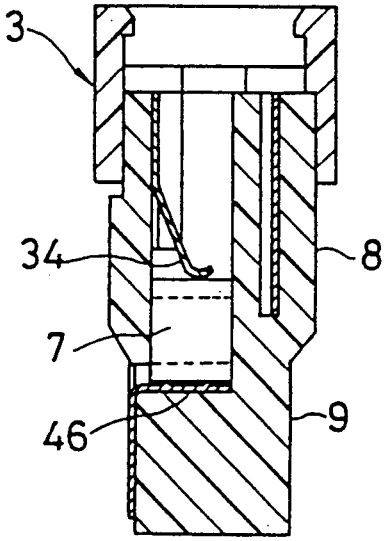
FIG. 7 is a sectional view taken along the line 7—7 of FIG. 4.
Figure 8:
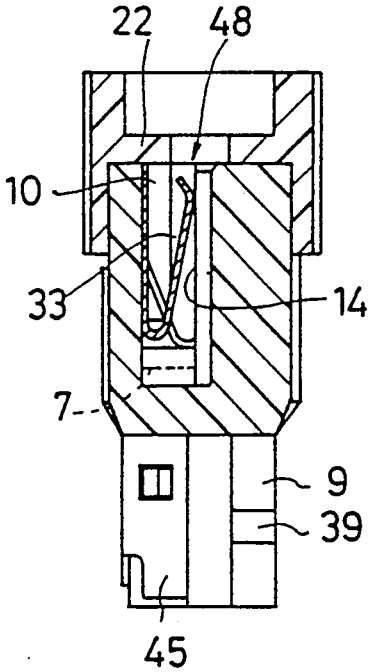
FIG. 8 is a sectional view taken along the line 8—8 of FIG. 4.
Figure 12:
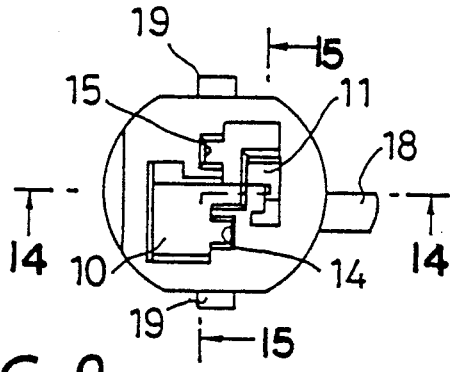
FIG. 12 is a top plan view of the case body.
Figure 9:
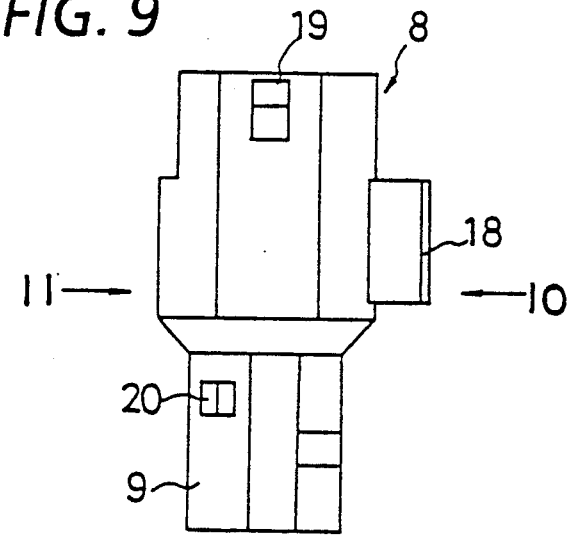
FIG. 9 is a front elevational view of a socket body according to an embodiment of the invention.
Figure 10:
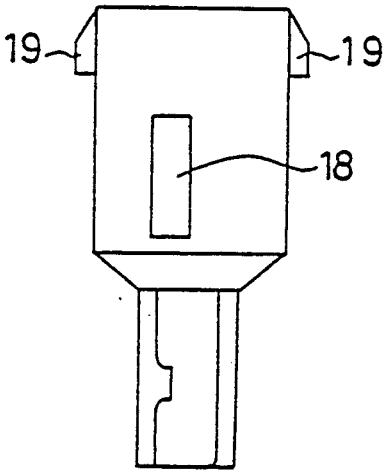
FIG. 10 is a right-hand side view of the case body.
Figure 11:
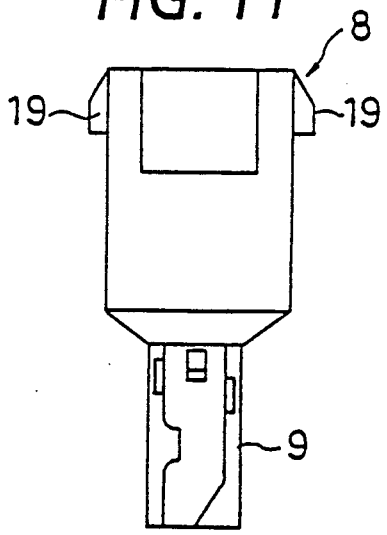
FIG. 11 is a left-hand side view of the case body.
Figure 13:
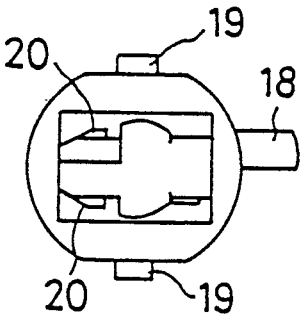
FIG. 13 is a bottom plan view of the case body.
Figure 14:
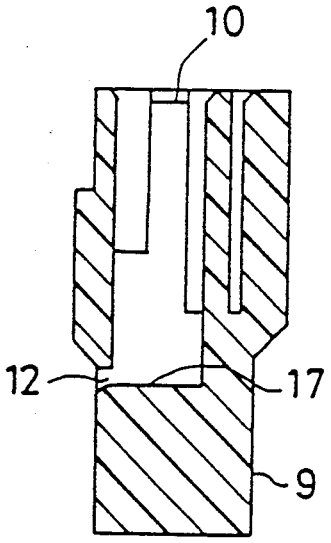
FIG. 14 is a sectional view taken along the line 14—14 of FIG. 12.
Figure 15:
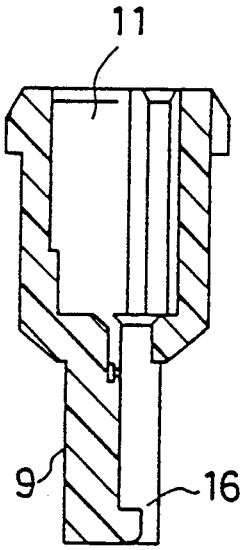
FIG. 15 is a sectional view taken along the line 15—15 of FIG. 12.
Figure 18:
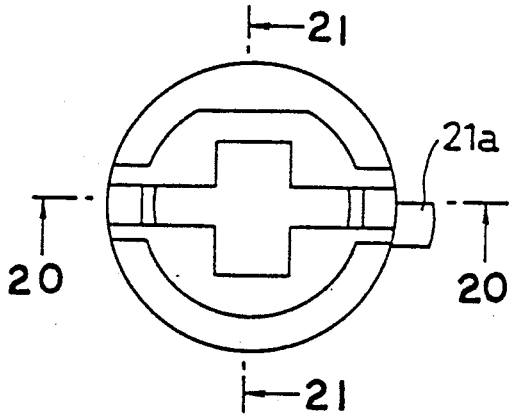
FIG. 18 is a top plan view of the cover.
Figure 20:
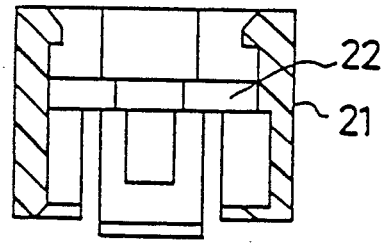
FIG. 20 is a sectional view taken along the line 20—20 of FIG. 18.
Figure 16:
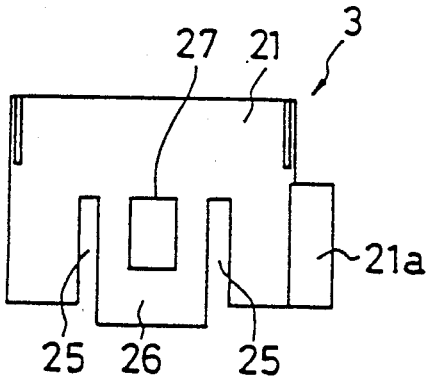
FIG. 16 is a front elevational view of a cover according to an embodiment of the invention.
Figure 17:
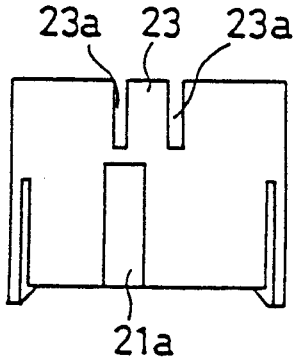
FIG. 17 is a right-hand side view of the cover.
Figure 19:
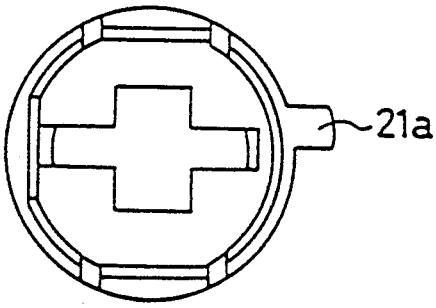
FIG. 19 is a bottom plan view of the cover.
Figure 21:
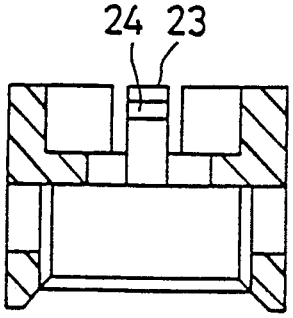
FIG. 21 is a sectional view taken along the line 21—21 of FIG. 18.
Figure 24:
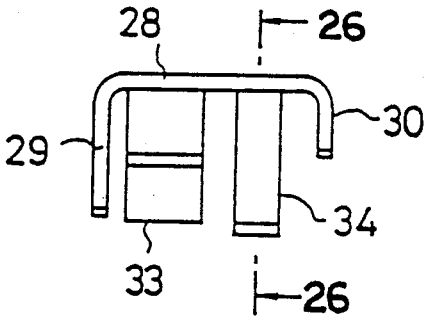
FIG. 24 is a left-hand side view of the lead terminal.
Figure 22:
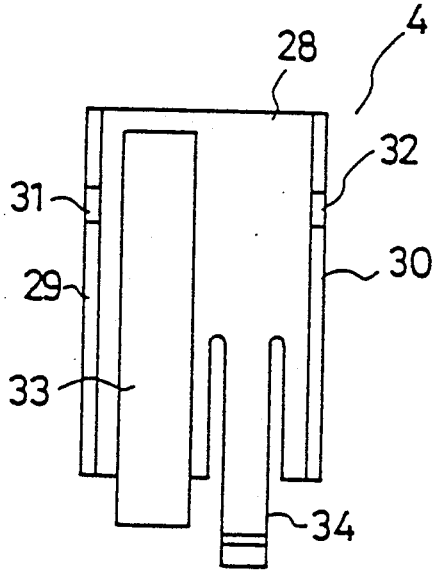
FIG. 22 is a front elevational view of a first lead terminal according to an embodiment of the invention.
Figure 23:
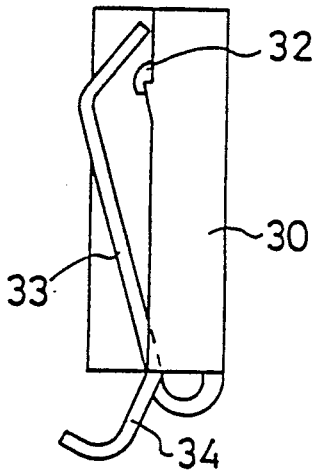
FIG. 23 is a right-hand side view of the lead terminal.
Figure 25:
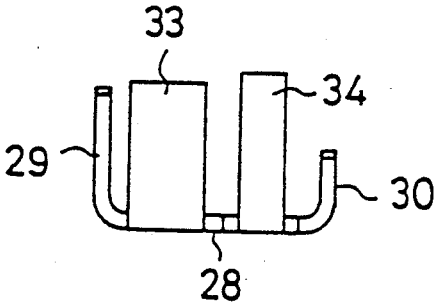
FIG. 25 is a bottom plan view of the lead terminal.
Figure 26:
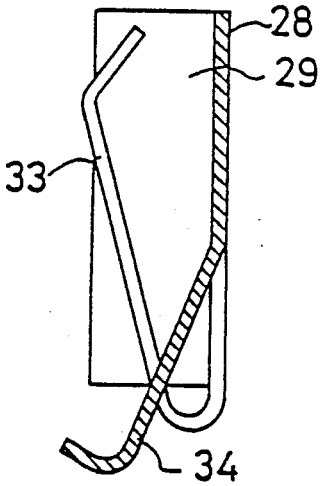
FIG. 26 is a sectional view taken along the line 26—26.
Figure 30:
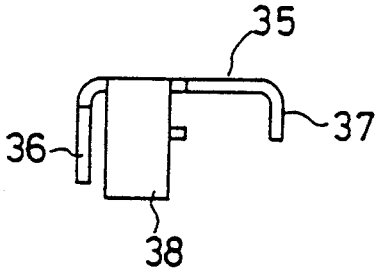
FIG. 30 is a bottom plan view of the lead terminal.
Figure 27:
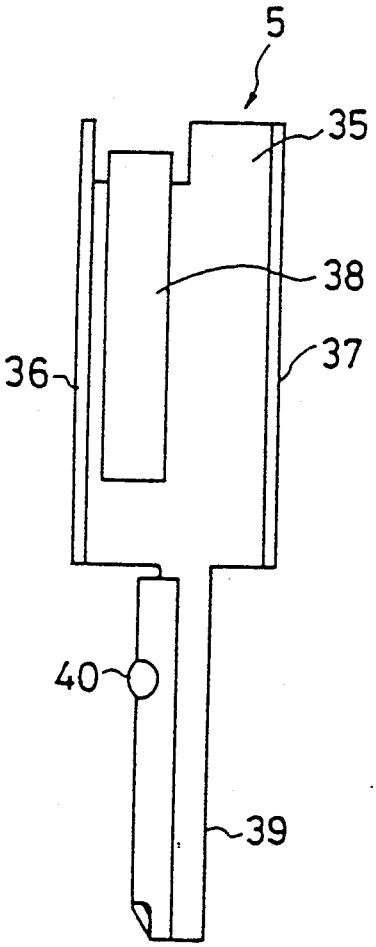
FIG. 27 is a front elevational view of a second lead terminal according to an embodiment of the invention.
Figure 28:
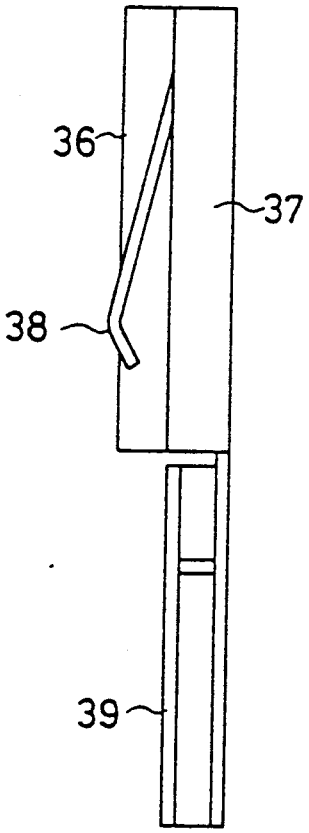
FIG. 28 is a right-hand side view of the lead terminal.
Figure 29:
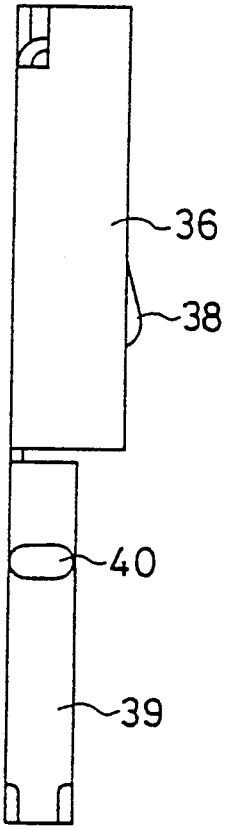
FIG. 29 is a left-hand side view of the lead terminal.
Figure 33:
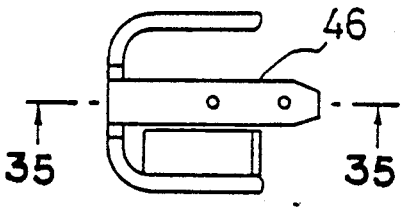
FIG. 33 is a top plan view of the contact terminal.
Figure 35:
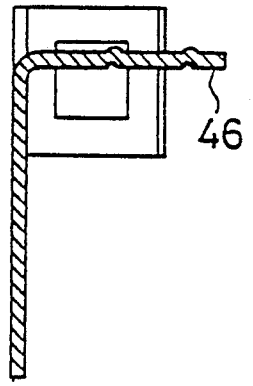
FIG. 35 is a sectional view taken along the line 35—35 of FIG. 33.
Figure 32:
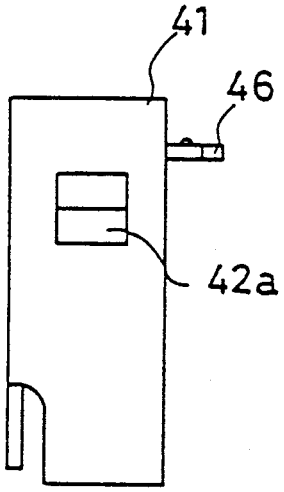
FIG. 32 is a left-hand side view of the contact terminal.
Figure 31:
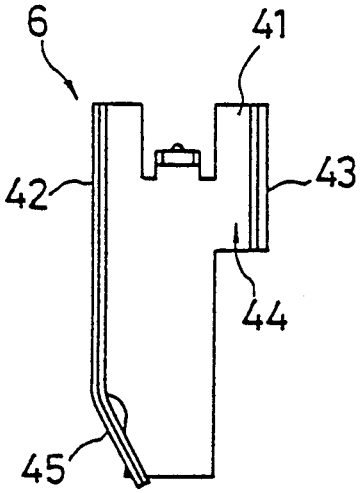
FIG. 31 is a front elevational view of a contact terminal according to an embodiment of the invention.
Figure 34:
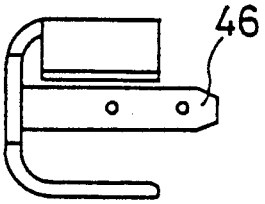
FIG. 34 is a bottom plan view of the contact terminal.

FIGS. 1–5 show a socket according to an embodiment of the invention. The removable socket 1 consists of a case body 8; a cover 3 cooperating with the socket body 8 to form a case 2; a pair of lead terminals 4 and 5; a contact terminal 6; and a resistor 7.

As FIGS. 9–15 show, the case body 8 has an lower insert portion 9 having a diameter less than that of an upper portion. The case body 8 has three terminal apertures 10, 11, and 12. The terminal apertures 10 and 11 are formed in a diagonally opposed positions and have abutment face 14 and 15, respectively. The terminal aperture 11 extends downwardly to the interior of the insert portion 9, at the front face of which a terminal opening 16 is formed. The terminal aperture 12 opens at the left-hand side of the insert portion 9 and communicates with a bottom portion 17 of the terminal aperture 10. A positioning projection 18 is provided on the right-hand side of the case body 8, and a pair of engagement projections 19 are provided on the front and rear faces of the case body 8. A pair of engagement projections 20 are provided on the front and rear faces of the insert portion 9.

As FIGS. 16–21 show, the cover 3 has a cylindrical body 21 which has a terminal retainer 22 therein and two pairs of slits 23*a* extending downwardly from the top edge thereof to form a pair of retention arms 23 therebetween. Each retention arm 23 has a projection 24 extending inwardly from the top edge thereof. Two pairs of slits 25 extend upwardly from the bottom edge of the cover body 21 to form a pair of latch arms 26 each having an engagement hole 27. A positioning projection 21*a* extends laterally from the outside of the cover body 21 for positioning.

As FIGS. 22–26 show, the first lead terminal 4 has a terminal body 28 with opposite sides bent at substantially right angles to form a pair of flanges 29 and 30. The left-hand flange 29 is wider than the right-hand flange 30. A pair of engagement projections 31 and 32 are provided on the edges of the flanges 29 and 30. A lead contact 33 extends upwardly from the bottom edge of the terminal body 28 and bent at a free end portion in an L shape. A resistor contact 34 is cut out of the lower portion of the terminal body 28 such that it extends downwardly and has a free end curved.

As FIGS. 27–30 show, the second lead terminal 5 has a terminal body 35 with a pair of flanges 36 and 37 bent at substantially right angles, the left-hand flange 36 being wider than the right-hand flange 37. A lead contact 38 extends downwardly from the top edge of the terminal body 35 and is bent at a free end in the L shape. An elongated contact 39 extends downwardly from the bottom edge of the terminal body 35 and has a retention projection 40 at the upper portion for preventing it from falling off.

As FIGS. 31–35 show, the contact terminal 6 has a terminal body 41 with a pair of flanges 42 and 43 bent at substantially right angles to form a gripping portion 44. The flange 42 extends downwardly to form a contact portion 45. A resistor contact 46 extends laterally from the upper edge of the terminal body 41. An engagement hole 42*a* is formed above the contact portion 45.

The retainer portion 44 of the contact terminal 6 is fitted into the insert portion 9 of the case body 8 so that the engagement projection 20 fits into the engagement hole 42*a* to attach the contact portion 45 to the insert portion 9 while the resistor contact 46 is fitted into the terminal aperture 12 to place the resistor contact 46 at the bottom of the terminal aperture 10. Then, the flat resistor 7 and the lead terminal 4 are placed into the terminal aperture 10 in this order so that the contact portions 7*a* and 7*b* of the resistor 7 are brought into contact with the resistor contact 46 of the contact terminal 6 and the resistor contact 34 of the lead terminal 4, respectively. The lead contact 33 of the lead terminal 4 is opposed to the abutment face 14 forming a lead aperture 48. Then, the lead terminal 5 is fitted into the terminal aperture 11 such that the contact element 39 is exposed via the terminal opening 16. The lead contact 38 of the lead terminal 5 is opposed to the abutment face 15 forming another LED lead insert portion 49. The cover 3 is then put on the case body 8 so that the engagement projection 19 snaps into the engagement hole 27 of the latch arm 26 thereby attaching the cover 3 to the case body 8 while securing the lead terminals 4 and 5 by pressing them down with the terminal retainer 22 of the cover 3.

Figure 36:
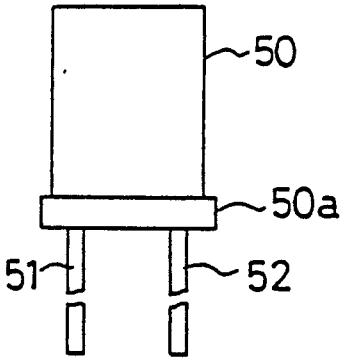
FIG. 36 is a front elevational view of a light emitting diode.
Figure 37:
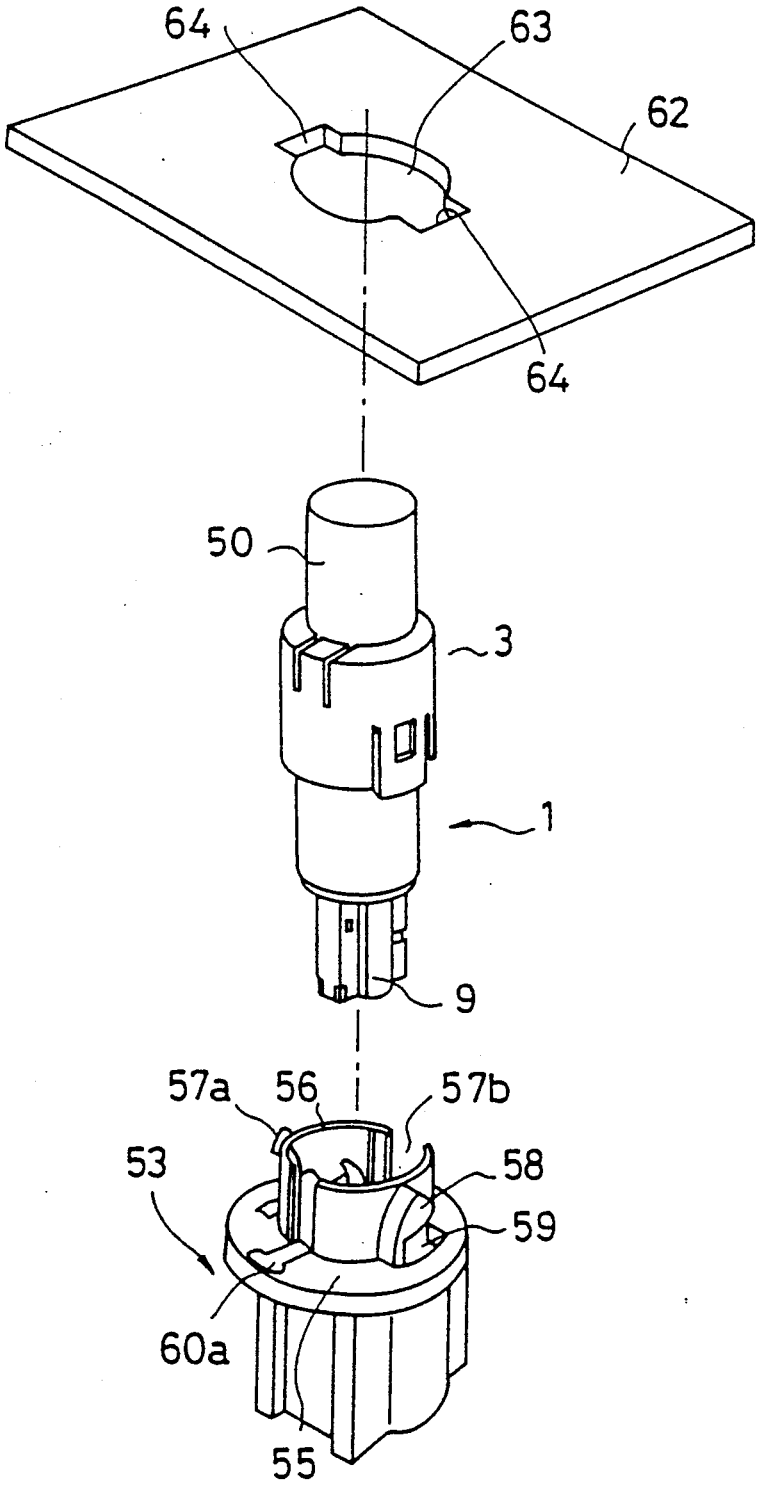
FIG. 37 is an exploded, perspective view of an indicator lamp according to an embodiment of the invention.
Figure 38:
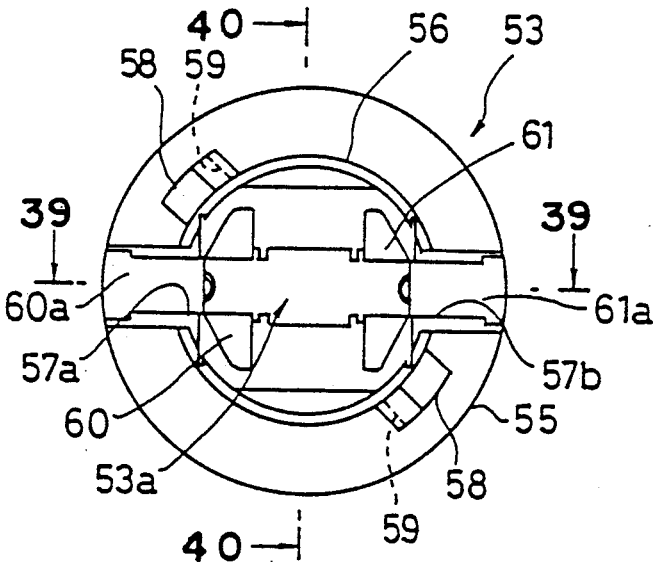
FIG. 38 is a top plan view of a PCB socket.
Figure 39:
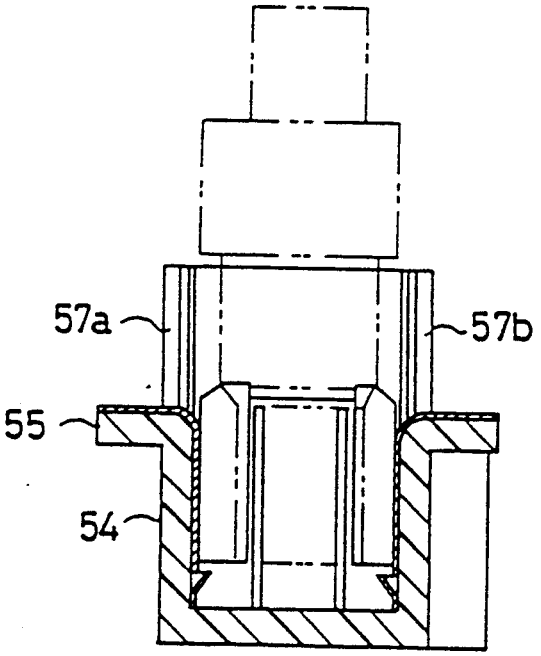
FIG. 39 is a sectional view taken along the line 39—39 of FIG. 38.
Figure 40:
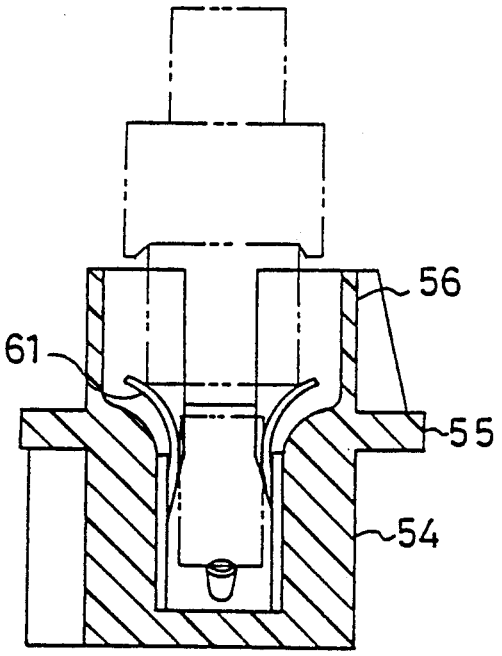
FIG. 40 is a sectional view taken along the line 40—40.
Figure 41:
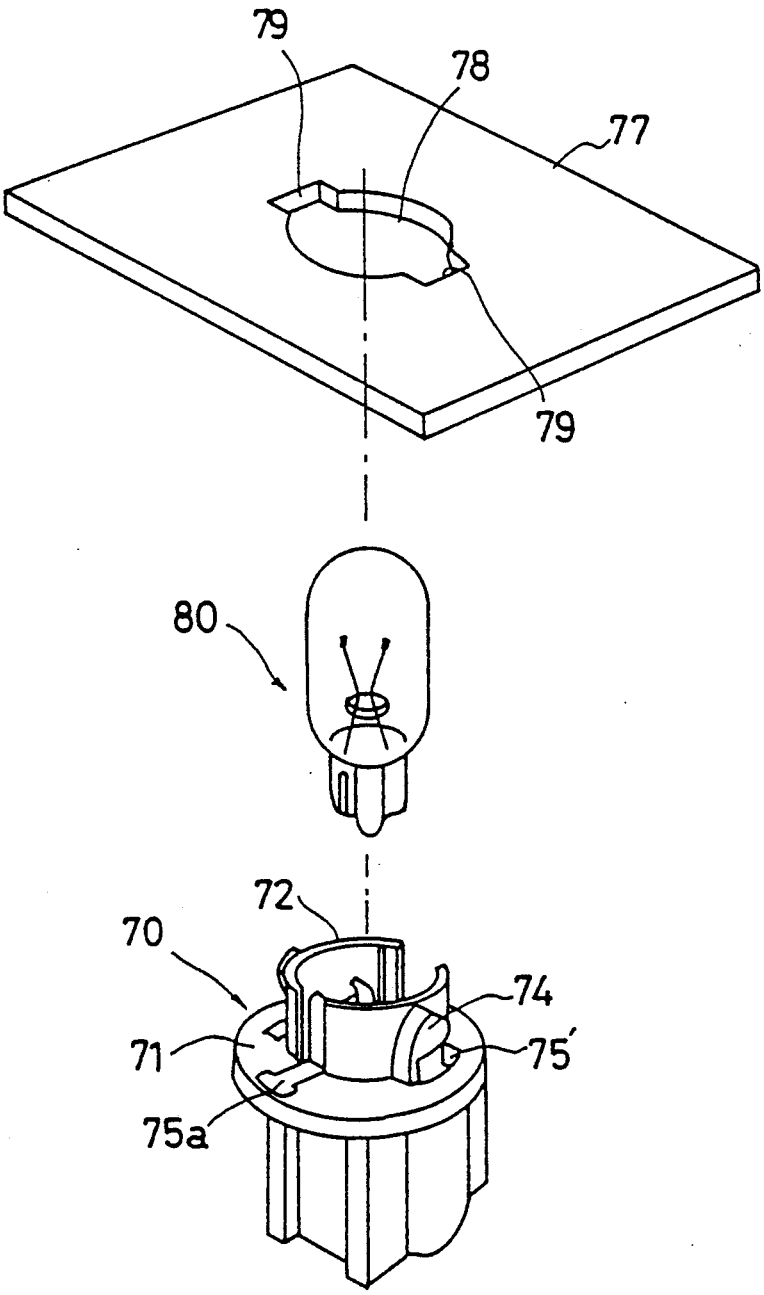
FIG. 41 PRIOR ART
FIG. 41 is an exploded, perspective view of a conventional indicator lamp.
Figure 42:
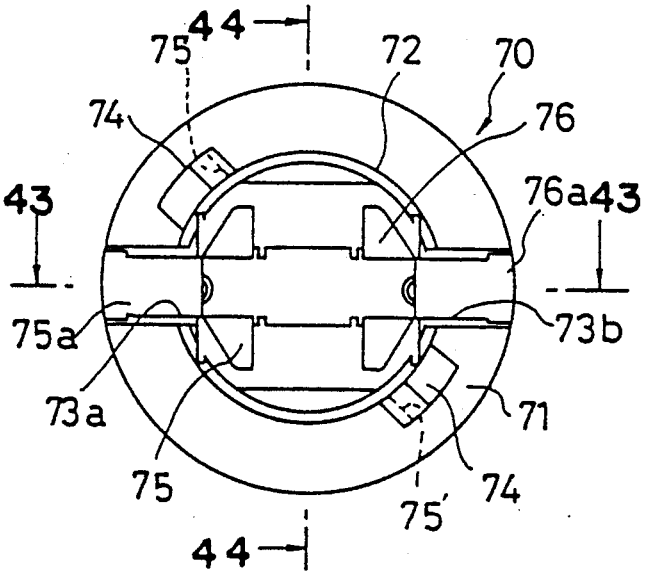
FIG.42 PRIOR ART
FIG. 42 is a top plan view of the PCB socket.
Figure 43:
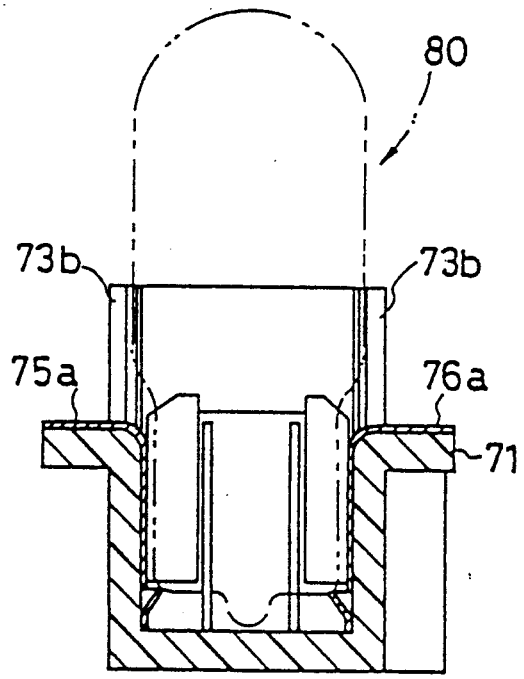
FIG.43 PRIOR ART
FIG. 43 is a sectional view taken along the line 43—43 of FIG. 42.
Figure 44:
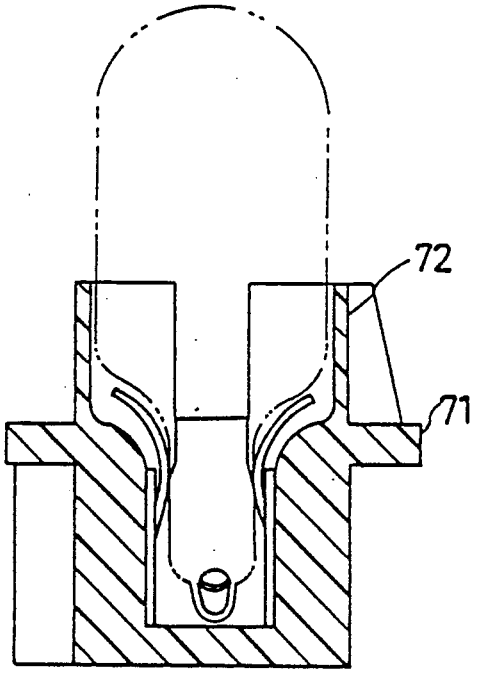
FIG.44 PRIOR ART
FIG. 44 is a sectional view taken along the line 44—44 of FIG. 42.

As FIG. 36 shows, the light emitting diode 50 has a pair of leads 51 and 52.

FIGS. 37–40 show a PCB socket 53 to be mounted on a printed circuit board (PCB) 62. The PCB socket 53 has a case body 54 which has an insert recess 53*a*, an abutment flange 55, and a cylindrical mouth 56 which has an pair of positioning slits 57*a* and 57*b*. A pair of latch arms 58 are provided on the outside of the mouth 56 and each have an engagement shoulder 59. A pair of contact elements 60 and 61 are provided within the insert recess 53*a* of the case body 54 and each have a contact portion 60*a* or 61*a* at a free end. The contact portions 60*a* and 61*a* extend radially on the PCB abutment flange 55 beyond the positioning slots 57*a* and 57*b*, respectively.

The PCB 62 has a socket mounting hole 63 which has a pair of notches 64.

How to mount the LED 50 on the socket 1, the socket on the PCB socket 53, and the PCB socket on the PCB 62 will be described below.

The leads 51 and 52 of the LED 50 are inserted into the lead apertures 48 and 49 of the socket 1 so that the lead 51 is held between the lead contacts 33 of the lead terminals 4 and the abutment face 14 while the lead 52 is held between the lead contact 38 of the lead terminal 5 and the abutment face 15 so that the lead 51 is pressed against the lead contacts 33 and 38, respectively. The flange 50*a* of the LED 50 is held by the retention arms 23 of the cover 3.

Then, the insert portion 9 of the socket 1 is inserted into the insert recess 53*a* of the PCB socket 53 so that the contact portion 39 of the lead terminal 5 and the contact portion 45 of the contact terminal 6 are brought into contact with the contact elements 60 and 61 of the PCB socket 53.

Then, the mounting mouth 56 of the PCB socket 53 is inserted into the mounting hole 63 of the PCB 62 so that the PCB abutment portion 55 abuts on the mounting face of the PCB 62, and the PCB socket 53 is rotated so that the edge of the socket mounting hole 63 engages the engagement shoulders 59 of the latch arms 58. Consequently, the contact portion 60*a* and 61*a* of the PCB abutment portion 55 are brought into contact with the respective mounting surfaces. The positioning projection 18 ensures that the insertion is made in only a certain direction.

As has been described above, the LED 50 is inserted into the removable socket 1, which in turn is mounted on the PCB socket 53, which in turn is mounted on the PCB to mount the LED 50 on the PCB 62. As a result, current flows from the contact portion of the PCB 62 to the PCB socket 53 to the contact terminal 6, the resistor 7, the lead terminal 4, the LED 50, the lead terminal 5, the PCB socket 53, and to the contact portion of the PCB 62 to turn on the LED 50.

As has been described above, with the indicator lamp according to the invention, it is possible to mount an LED on a PCB by attaching the LED to a removable socket; then the removable socket to a PCB socket, and finally the PCB socket to the PCB.

Thus, an LED is replaced for an incandescent lamp, thereby eliminating the disadvantages of the incandescent lamp such as high power consumption, vulnerability to vibration and shock, short service time, and considerable heat generation. However, an incandescent lamp may also be mounted on the PCB socket.

What is claimed:

1. An indicator lamp employing a light emitting diode with a pair of leads, comprising:

a PCB socket to be mounted on a printed circuit board;

a removable socket having an insert portion to be fitted into said PCB socket;

a first lead terminal provided in said removable socket and having a resistor contact and a first lead contact for contact with one of said leads;

a second lead terminal provided in said removable socket and having a first contact portion and a second lead contact for contact with the other lead;

a contact terminal provided within said removable socket and having a second contact portion and a second resistor contact; and a resistor provided within said removable socket so that said resistor is held between said first and second resistor contacts.

* * * * *